US007694844B2

(12) United States Patent
Woo

(10) Patent No.: US 7,694,844 B2
(45) Date of Patent: Apr. 13, 2010

(54) SPOON BASKET STRUCTURE OF DISH WASHER

(75) Inventor: Sang Woo Woo, Kyeongsangbook-do (KR)

(73) Assignee: LG Electronics Inc., Seoul (KR)

( * ) Notice: Subject to any disclaimer, the term of this patent is extended or adjusted under 35 U.S.C. 154(b) by 867 days.

(21) Appl. No.: 10/573,916

(22) PCT Filed: Aug. 5, 2005

(86) PCT No.: PCT/KR2005/002559

§ 371 (c)(1),
(2), (4) Date: Mar. 30, 2006

(87) PCT Pub. No.: WO2006/016759

PCT Pub. Date: Feb. 16, 2006

(65) Prior Publication Data

US 2006/0289041 A1 Dec. 28, 2006

(30) Foreign Application Priority Data

Aug. 9, 2004 (KR) ..... 10-2004-0062377

(51) Int. Cl.
*B65D 25/28* (2006.01)
*B65D 43/20* (2006.01)
*A47F 7/00* (2006.01)

(52) U.S. Cl. ..... 220/756; 220/812; 211/70.7

(58) Field of Classification Search ..... 220/752, 220/488, 487, 676, 23.2, 815, 812, 811, 810, 220/345.4, 345.1, FOR. 192, FOR. 189, FOR. 187; 211/70.7; 209/926; *A47L 15/50*
See application file for complete search history.

(56) References Cited

U.S. PATENT DOCUMENTS

| | | | | | |
|---|---|---|---|---|---|
| 253,473 | A | * | 2/1882 | Gough | 220/815 |
| 3,050,073 | A | * | 8/1962 | McMillan | 134/137 |
| 3,508,571 | A | | 4/1970 | Dutcher et al. | |
| 3,935,958 | A | * | 2/1976 | Frangos | 220/488 |
| 5,287,984 | A | | 2/1994 | Michael | |
| 5,431,294 | A | | 7/1995 | Stottmann et al. | |
| D487,825 | S | * | 3/2004 | Kim et al. | D32/3 |

FOREIGN PATENT DOCUMENTS

| | | | | |
|---|---|---|---|---|
| EP | 914801 | A | | 5/1999 |
| GB | 2198032 | A | * | 6/1988 |
| JP | 05-044050 | U | | 6/1993 |
| KR | 1999-62152 | A | | 7/1999 |

OTHER PUBLICATIONS

International Search Report dated Nov. 17, 2005.

* cited by examiner

*Primary Examiner*—Anthony Stashick
*Assistant Examiner*—Robert J Hicks
(74) *Attorney, Agent, or Firm*—McKenna Long & Aldridge LLP

(57) ABSTRACT

A spoon basket of a dishwasher is provided. The spoon basket includes a basket for storing silverware, a cap that is disposed on top of the basket to move up and down, and a basket handle that extends a predetermined distance from the basket and supports the cap.

15 Claims, 5 Drawing Sheets

SPOON BASKET STRUCTURE OF DISH WASHER

This application claims priority to International application No. PCT/KR2005/002559 filed on Aug. 5, 2005, Korean Application No. 10-2004-62377 filed on Aug. 9, 2004, both of which are incorporated by reference, as if fully set forth herein.

TECHNICAL FIELD

The present invention relates to a dishwasher, and more particularly, to a spoon basket of a dishwasher that rests in a dish rack and stores silverware inside.

BACKGROUND ART

A dishwasher is a machine for washing dishes and has an upper spray arm and a lower spray arm installed in a tub. The spray arms spray pressurized wash liquid onto dishes to clean them of food deposits.

A dishwasher has a dish rack installed inside to hold dishes. A separate spoon basket for storing silverware, cooking utensils, etc. is additionally installed on one end of the dish rack. Accordingly, silverware does not fall through holes at the bottom of the dish rack onto the floor of the tub when it is stored along with dishes in the dish rack. Also, arranging silverware after a dishwashing cycle is easier because the silverware is collectively stored in the rack.

A spoon basket for installation in a dish rack as described above is disclosed in Korean Utility Model No. 20-1997-0001 115, filed by the applicant of this invention, which is hereby incorporated by reference.

In related art dishwasher spoon baskets, however, the downside of storing silverware and utensils collectively is that longer items, such as ladles have a tendency to fall out of the basket or to lean sideways and interfere with adjacently stored large dishes or the dishwasher door.

DISCLOSURE OF INVENTION

Technical Problem

An object of the present invention is to provide a spoon basket for a dishwasher having various heights for securely storing longer pieces of silverware and utensils.

Technical Solution

According to an aspect of the present invention, a spoon basket for a dishwasher includes a basket for storing silverware, a cap for moving upwards and downwards above the basket, and a basket handle extending a predetermined length from the basket for supporting the cap.

According to another aspect of the present invention, a spoon basket for a dishwasher includes: a basket; a basket handle having a cap support extending a pre-determined height from the basket; a cap for moving upwards and downwards along the cap support; and a height-adjusting tab and a guide slot formed respectively on the cap and the cap support to be mutually coupled, the height-adjusting tab and the guide slot for guiding an upward and downward movement of the cap.

According to a further aspect of the present invention, a spoon basket for a dishwasher includes a basket for storing silverware, a cap disposed at a predetermined distance from the basket for supporting the silverware, and a basket handle extending from the basket for supporting the cap.

ADVANTAGEOUS EFFECTS

The spoon basket structure of a dishwasher according to the present invention can prevent longer silverware items that are stored in the basket from toppling and falling out of the basket. Even if silverware of assorted lengths should be stored in the spoon basket, they will be prevented from toppling and falling out of the basket. Therefore, the spoon basket is able to store silverware more securely.

BRIEF DESCRIPTION OF THE DRAWINGS

The spirit of the present invention can be understood more fully with reference to the accompanying drawings. In the drawings.

BEST MODE FOR CARRYING OUT THE INVENTION

Hereinafter, preferred embodiments of a spoon basket of a dishwasher according to the present invention will be described in detail with reference to the accompanying drawings.

Figure 1:
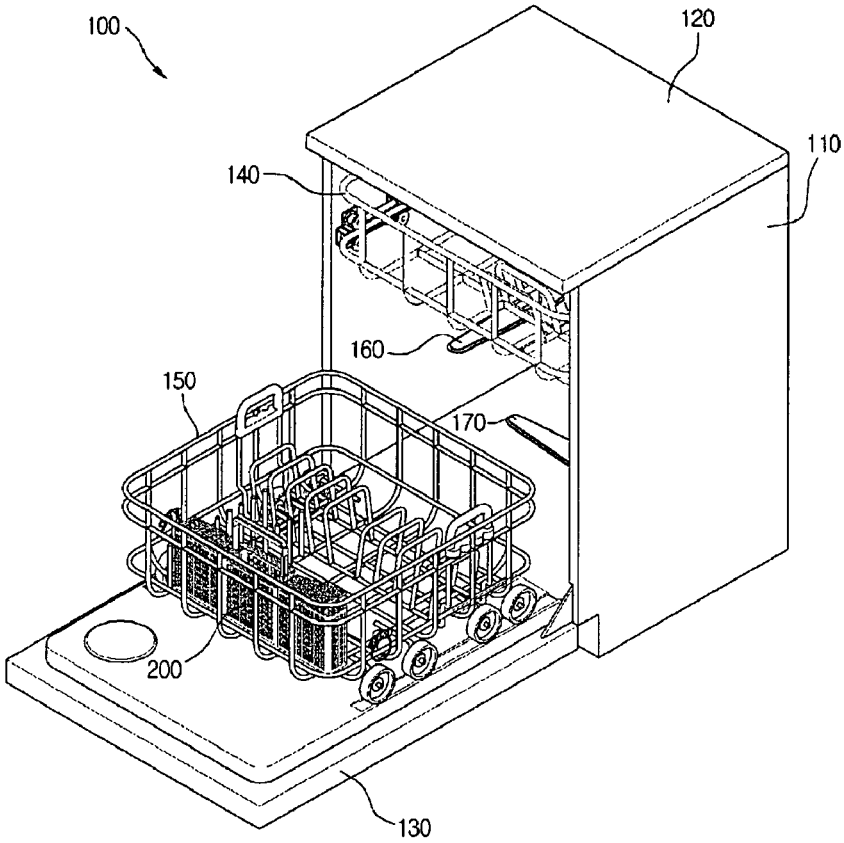
FIG. 1 is a perspective view of a dishwasher with a spoon basket installed therein according to the present invention.

FIG. 1 is a perspective view of a dishwasher with a spoon basket installed therein according to the present invention.

Referring to FIG. 1, a dishwasher 100 with the spoon basket includes a tub 110 forming the outer shape of the dishwasher 100, a top cover 120 mounted on the top surface of the tub 110, and a door 130 attached to the front of the tub 110.

Additionally, the dishwasher 100 includes: an upper rack 140 and a lower rack 150 disposed inside the tub 110 for storing dishes, a spoon basket 200 disposed on the upper rack 140 or the lower rack 150 for storing silverware, an upper spray arm 160 for spraying wash liquid towards the upper rack 140, and a lower spray arm 170 for spraying wash liquid towards the lower rack 150.

To describe the operation of the above dishwasher 100, a user first opens the door 130, after which (s)he places dishes in the upper rack 140 and/or the lower rack 150. Next, after placing silverware in the spoon basket disposed in the upper or lower rack 140 or 150, the user closes the door 130. Then, dishwashing settings are inputted, and the "start" button is pressed to begin the wash cycle according to the settings.

Figure 2:
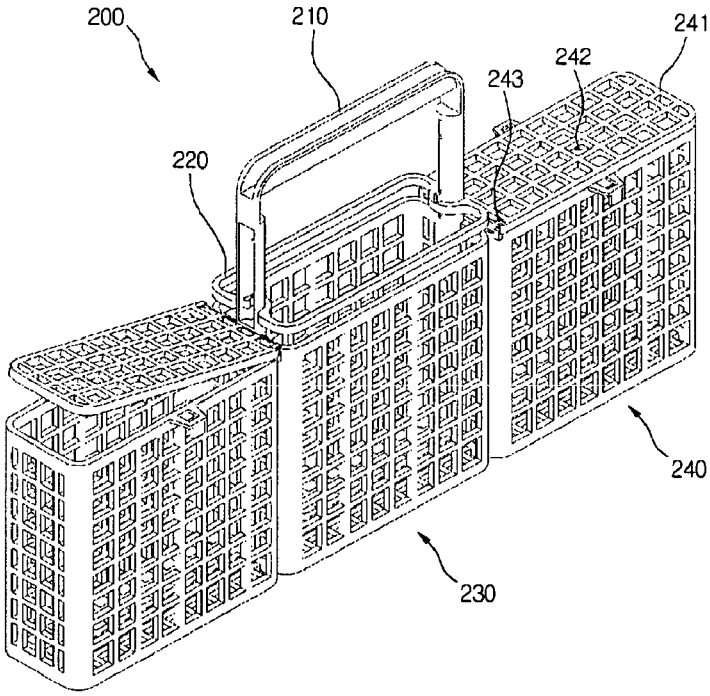
FIG. 2 is a perspective view of a spoon basket according to the present invention.

FIG. 2 is a perspective view of a spoon basket according to the present invention.

Referring to FIG. 2, the spoon basket 200 includes: a center basket 230 having roughly six sides with the top side open, and disposed in the center of the spoon basket 200; a side basket 240 attached to the side of the center basket 230, and a basket handle 210 formed to rise a predetermined height from the sides edges of the center basket 230. The side basket 240 may be detachably mounted to the center basket 230.

In further detail, the spoon basket 200 has a plurality of holes formed on its surfaces to allow wash liquid to pass through the holes to the outside. The side basket 240 has a cover 241 attached to the top thereof via a hinge 243 disposed on an upper edge of the side basket 240. The cover 241 pivots on the axis of the hinge 243 to open the top of the side basket 240. The cover 241 includes a plurality of silverware through-holes 242 formed thereon to allow silverware that is longer than the height of the side basket 240 to be stored therein by partially protruding through the silverware through-holes 242. The silverware through-holes 242 provide support to silverware protruding therethrough, preventing the silverware from toppling and falling out of the side basket 240.

To place silverware in the side basket 240, the cover 241 is lifted open, and shorter silverware is placed inside the side basket 240. After closing the cover 241, silverware that is longer than the height of the side basket 240 is inserted through the silverware through-holes 242.

A height-adjustable cap 220 is disposed within the basket handle 210 that is formed to extend a predetermined distance upward from the side edges of the center basket 230. The cap 220 is formed in a closed curvature, and can prevent longer silverware that is stored in the center basket 230 from falling out. The cap 220 is inserted along both ends of the basket handle 210 so that it can be raised or lowered along the ends of the basket handle 210. When the height of the cap 220 is adjusted, silverware in the center basket 230 that is longer than the height of the center basket 230 can be held more securely therein. The structure of the cap 220 and its function will now be explained with reference to the diagrams.

Figure 3:
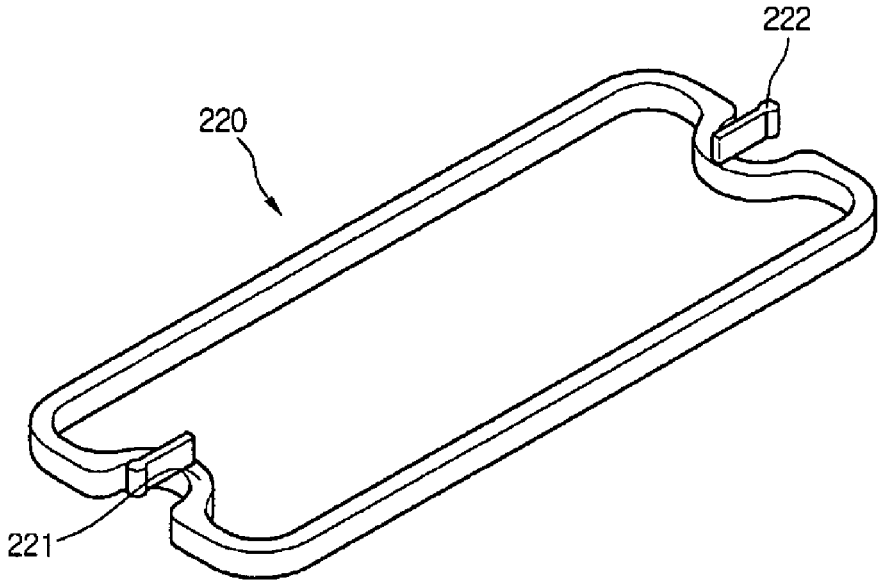
FIG. 3 is a perspective view of a cap for the spoon basket according to the present invention.
Figure 4:
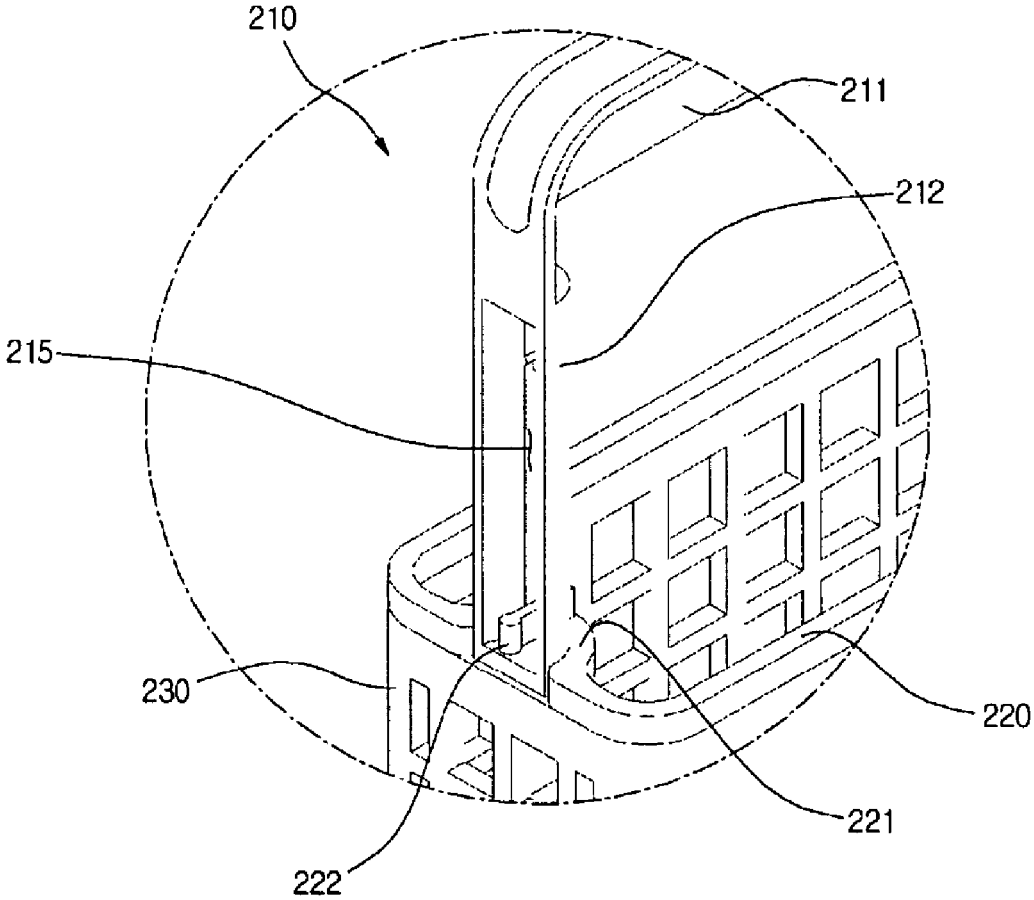
FIG. 4 is an enlarged perspective view showing the cap of FIG. 3 installed on a basket handle of the spoon basket.

FIG. 3 is a perspective view of a cap for the spoon basket according to the present invention, and FIG. 4 is an enlarged perspective view of the cap of FIG. 3 installed on a basket handle of the spoon basket.

Referring to FIGS. 3 and 4, the spoon basket 200 includes a basket handle 210 formed thereon, and a cap 220 installed on the basket handle 210. The cap 220 is in the rough shape of a rectangular band.

In more detail, on each of the two shorter sides of the cap 220 is a basket handle recess 221 concaved a predetermined distance inward, and a height-adjusting tab 222 formed above the basket handle recess 221 and protruding a predetermined distance outward.

In addition, the basket handle 210 includes a cap support 212 extending a pre-determined distance perpendicularly upward from the top of the center basket 230, and a handle 211 curving horizontally from the top of the cap support 212 for a user to grasp. The cap support 212 is concaved a predetermined distance inward.

The cap 220 is disposed to the inside of the cap support 212, and the height-adjusting tab inserts into a guide slot 215 formed along the cap support 212. The basket handle recess 221 contacts the inner surface of the concaved cap support 212.

Figure 5:
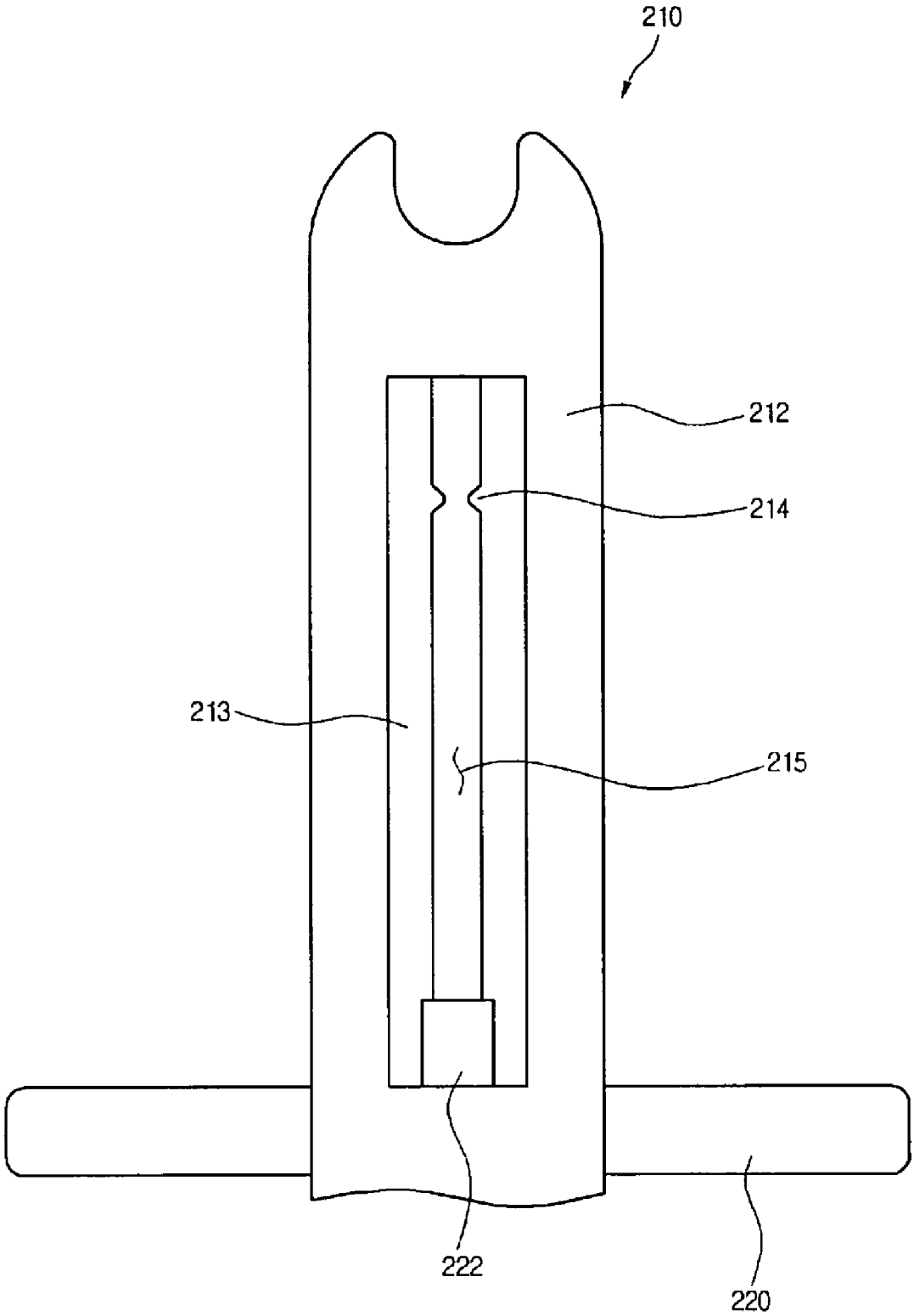
FIG. 5 is a side plan view of the cap and basket handle of the spoon basket according to the present invention.

FIG. 5 is a side plan view of the cap and basket handle of the spoon basket according to the present invention.

Referring to FIG. 5, the basket handle 210 can be grasped by a user to facilitate carrying of the spoon basket 200.

More specifically, the basket handle 210 includes a cap support 212. The cap support 212 has an inwardly concaved cap support concaved portion 213, and a guide slot 215 of a predetermined width and height formed perpendicularly in the approximate center of the cap support concaved portion 213. Also, at least one stop 214 is formed to protrude on an extremity of the guide slot 215.

In still further detail, the stop 214 protrudes inward into the guide slot 215 at an extremity thereof, so that it catches the height-adjusting tab 222. In other words, when the height-adjusting tab 222 is moved past and above the stop 214, the cap 220 is prevented from sliding down and is fixed by the stop 214.

Here, at least one or more of the stop 214 may be formed to adjust the height of the cap 220. The cap 220 may be elevated in stages, depending on the number of stops 214 formed.

Figure 6:
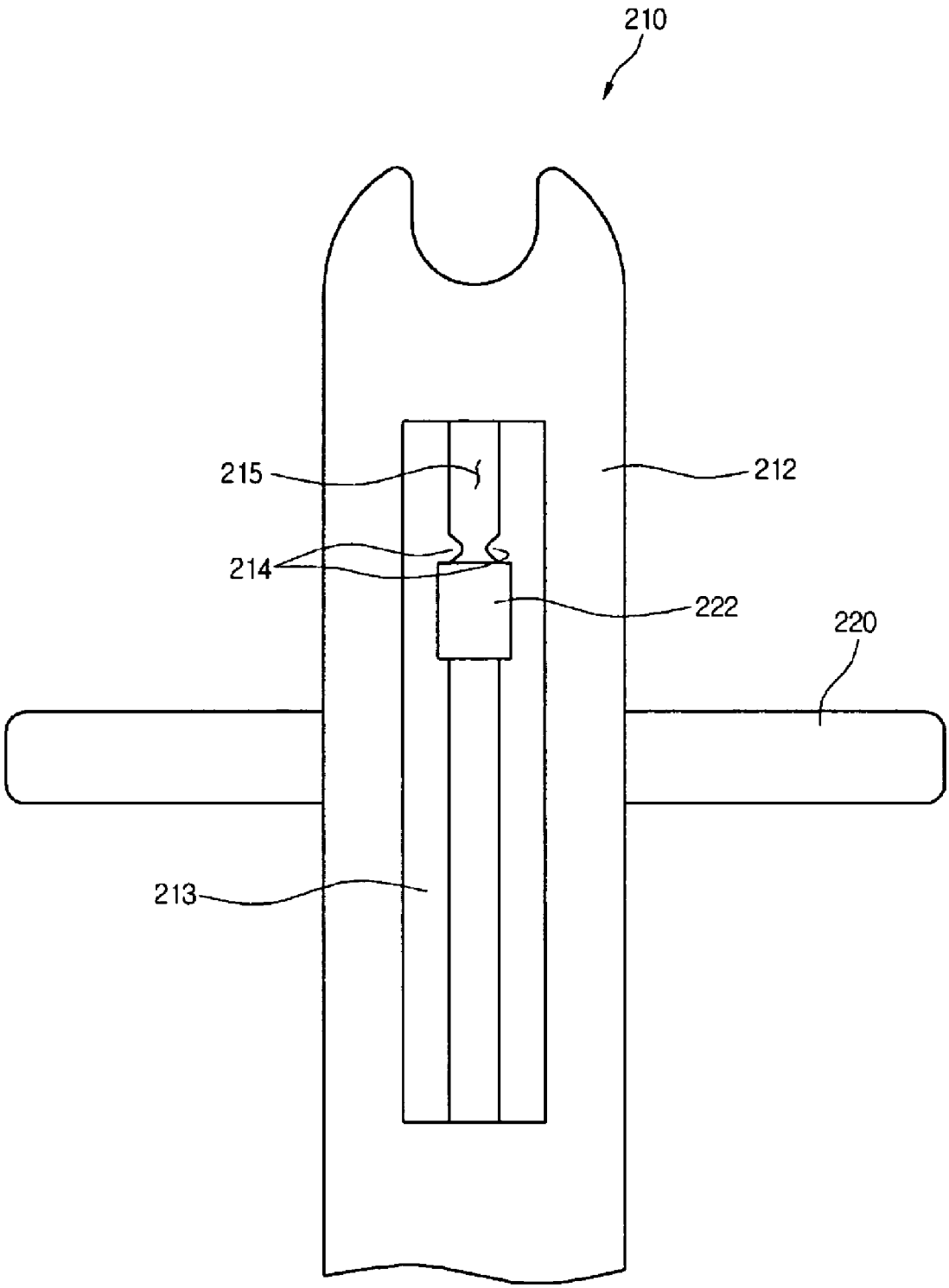
FIG. 6 is a side plan view showing the cap raised up to the stop of the basket handle of the spoon basket according to the present invention.
Figure 7:
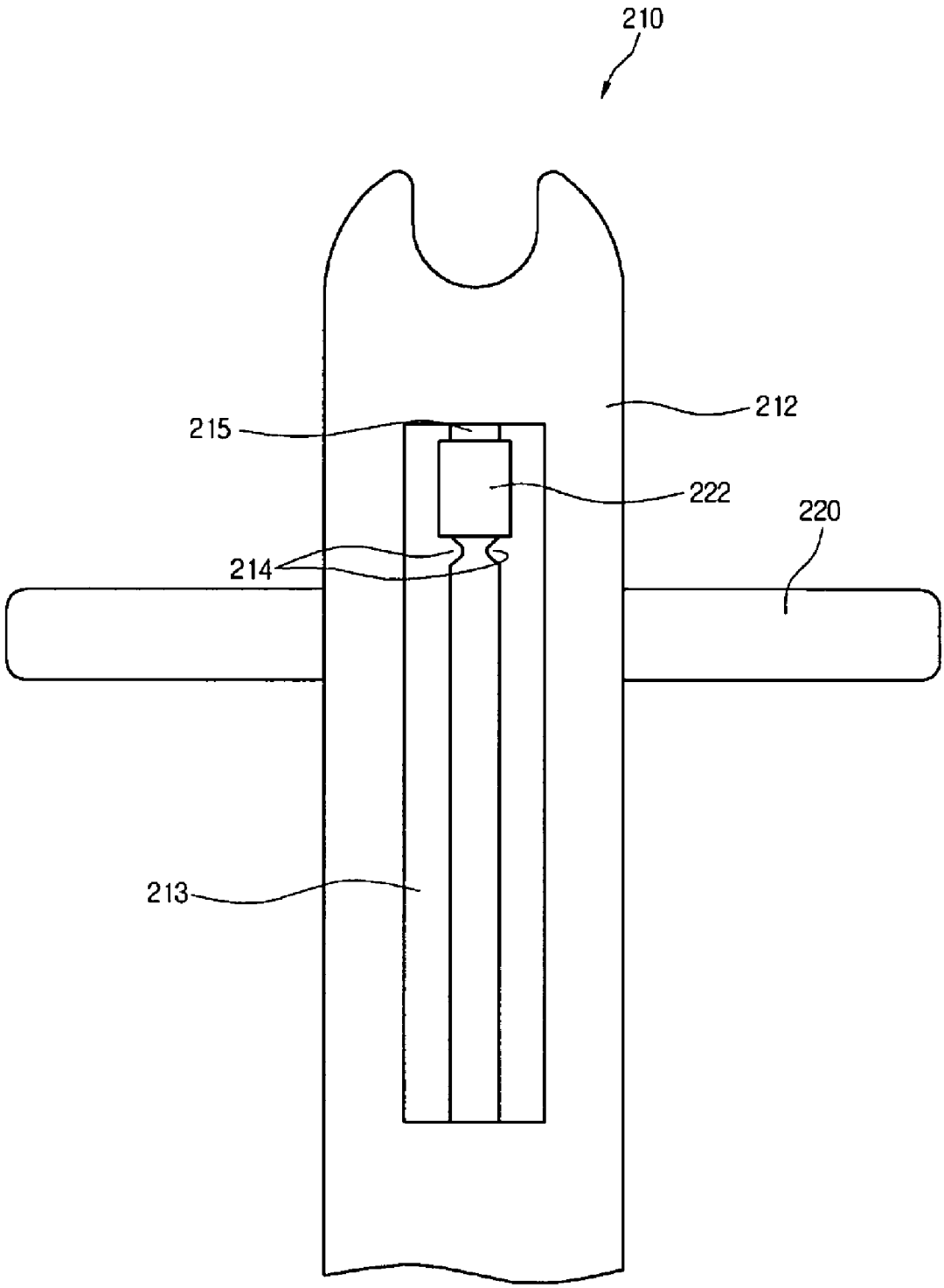
FIG. 7 is a side plan view showing the cap caught by the stop of the basket handle in FIG. 6.

FIG. 6 is a side plan view showing the cap raised up to the stop of the basket handle of the spoon basket according to the present invention, and FIG. 7 is a side plan view showing the cap caught by the stop of the basket handle in FIG. 6.

Referring to FIGS. 6 and 7, the height of the cap 220 is adjusted by latching the height-adjusting tab 222 (formed in one piece with the cap 220 on the sides thereof) above the stop 214. The number of height levels that the cap 220 can be adjusted to depends on the number of stops 214 formed.

In detail, when a user wishes to place utensils or silverware that is longer than the height of the center basket 230 in the center basket 230, the cap 220 can be moved to an appropriate height. The vertical width of the height-adjusting tab 222 attached to the sides of the cap 220 is made to be slightly wider than the vertical width of the guide slot 215 at the stop 214. When the cap 220 is disposed directly below the stop 214, the height-adjusting tab 222 can bypass the stop by momentarily applying a slight pre-determined force thereto. The heigh adjusting tab 222 then comes to rest above the stop 214, as shown in FIG. 7. Even if the above height-adjusting tab 222 were to fall due to gravity, its movement would be arrested by the stop 214. If a predetermined external force is not applied thereto, the height-adjusting tab 222 will remain in a latched position above the stop 214. Accordingly, the cap 220 can retain a pre-determined position above the center basket 230.

When the cap 220 is disposed a predetermined position above the center basket 230 as described above, longer silverware can be supported by the cap 220. Accordingly, the silverware toppling or falling out of the center basket 230 can be prevented, and thus, the silverware can be securely stored in the spoon basket 200.

Furthermore, when silverware of various lengths are stored, the cap 220 can be freely height-adjusted to match the length of the silverware, to prevent the silverware from toppling or interfering with adjacent dishes. Therefore, silverware of various lengths can be stored.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The spoon basket of the dishwasher according to the present invention is capable of holding silverware of various lengths, and securely holding longer pieces of silverware, thereby providing a wide industrial application.

The invention claimed is:

1. A spoon basket of a dishwasher, comprising:

a basket for storing silverware;

a basket handle extending a predetermined length upwards from the basket; and a cap adapted to straightly move up and down by sliding along the basket handle, the cap having a hole through which the silverware passes, wherein a height of the cap is changed by moving the cap straightly up and down along the basket handle, and the silverware can be inserted in the basket through the hole and supported by the cap regardless of the height of the cap.

2. The spoon basket according to claim 1, wherein the cap is formed in a closed curvature.

3. The spoon basket according to claim 1, wherein the cap includes a side concaved a predetermined distance inward for resting against a predetermined portion of the basket handle.

4. The spoon basket according to claim 1, wherein the cap includes a height-adjusting tab on at least one side thereof protruding a predetermined height.

5. The spoon basket according to claim 1, wherein the basket includes another basket detachably disposed on at least one side thereof.

6. The spoon basket according to claim 1, further comprising a height-adjusting tab and a guide slot formed respectively on the cap and the basket handle to be mutually coupled, the height-adjusting tab and the guide slot for guiding an upward and downward movement of the cap.

7. A spoon basket of a dishwasher, comprising:

a basket;

a basket handle extending a predetermined height from the basket;

a cap support formed to be extended in up and down direction at side surfaces of the basket handle;

a guide slot formed to be extended in up and down direction at the cap support; and a cap having a height-adjusting tab which is inserted into the guide slot, wherein the cap support extends a predetermined distance perpendicularly upward from a top of the basket, and the cap is straightly moved up and down by sliding of the height-adjusting tab along the guide slot, and the silverware is stored in the basket by passing through the cap and supported by the cap.

8. The spoon basket according to claim 7, wherein the guide slot is formed of a predetermined width and length in a longitudinal direction of the cap support.

9. The spoon basket according to claim 7, wherein the cap support includes a concaved central portion defining the guide slot.

10. The spoon basket according to claim 7, wherein the cap support includes a stop formed therein for stopping the upward and downward movement of the cap.

11. The spoon basket according to claim 10, wherein the stop protrudes a predetermined distance from an extremity of the cap support forming the guide slot.

12. The spoon basket according to claim 10, wherein the stop is formed at an upper portion of the guide slot.

13. The spoon basket according to claim 1, wherein the cap is separate with the basket and is spaced a predetermined distance from the basket.

14. The spoon basket according to claim 1, wherein the cap and the basket handle include an uneven portion formed thereon for providing coupling therebetween to guide a movement of the cap.

15. The spoon basket according to claim 1, further comprising a stop for stopping a movement of the cap, wherein the stop protrudes inward into the guide slot at an extremity thereof.

* * * * *